US009424819B1

(12) United States Patent
Jones

(10) Patent No.: US 9,424,819 B1
(45) Date of Patent: Aug. 23, 2016

(54) CORROSION-RESISTANT WOUND MUSICAL STRING

(71) Applicant: Terry Jones, Oakridge, MO (US)

(72) Inventor: Terry Jones, Oakridge, MO (US)

( * ) Notice: Subject to any disclaimer, the term of this patent is extended or adjusted under 35 U.S.C. 154(b) by 252 days.

(21) Appl. No.: 14/211,473

(22) Filed: Mar. 14, 2014

Related U.S. Application Data

(60) Provisional application No. 61/794,104, filed on Mar. 15, 2013.

(51) Int. Cl.
*G10D 3/10* (2006.01)

(52) U.S. Cl.
CPC ..... *G10D 3/10* (2013.01)

(58) Field of Classification Search
CPC .. G10D 3/10; D07B 2801/22; D07B 2205/10; D07B 2205/2046; C23C 14/12; C23C 16/30
USPC ..... 84/297 R, 297 S
See application file for complete search history.

(56) References Cited

U.S. PATENT DOCUMENTS 3,099,595 A * 7/1963 Allbaugh ..... G10D 3/10 156/172
4,539,228 A 9/1985 Lazarus
5,578,775 A * 11/1996 Ito ..... D01F 11/127 428/364
6,528,709 B2 3/2003 Hebestreit et al.
7,531,730 B2 5/2009 Everly
7,608,766 B2 10/2009 Shlesinger
2002/0136893 A1* 9/2002 Schlesinger ..... C23C 14/12 428/375
2008/0236361 A1* 10/2008 Tambara ..... G10D 3/10 84/297 S

* cited by examiner

*Primary Examiner* — Kimberly Lockett
(74) *Attorney, Agent, or Firm* — Etherton Law Group, LLC

(57) ABSTRACT

A method of making a corrosion-resistant string for a musical instrument. The method improves the core wire-to-wrap wire bond by using a bond coating between the core and wrap wires that preferably also minimizes the galvanic activity between them. The bondable coating is applied to the core or wrap wires, or both. In one embodiment the method entails creating a coated core wire by annealing bare core wire, bathing the bare core wire in a bondable coating material and removing any excess, drying the bondable coating, making the string using the bondable-coated core wire, and reflowing the bondable coating. In another embodiment the method entails additionally coating the wrap wire with a coating that does not reflow under the same conditions as the bondable coating on the core wire, and winding the coated wrap wire around the bondable-coated core wire before reflowing the bondable coating.

5 Claims, 6 Drawing Sheets

CORROSION-RESISTANT WOUND MUSICAL STRING

FIELD OF INVENTION

The present invention relates generally to a method of manufacturing wound musical instrument strings, and more particularly to a method of manufacturing corrosion-resistant strings by applying an electrically insulative coating between the core and wrap wires.

BACKGROUND

A musical instrument string is made of a core of material and optionally strands of the same or other material spiral-wrapped around the core. The composition and dimensions of the core and the optional wrap are chosen so as to produce the desired tones when the string is caused to vibrate. Common materials for core wires include steel, brass, and nylon. Wrap wires are typically metal, including bronze, brass, tin, aluminum, silver, chrome, steel, and alloys thereof, the choice depending on the sound desired and other characteristics. Different types of musical strings are employed on each kind of instruments such as acoustic guitar, electric guitar, bass guitar, violin, cello, bass, banjo, piano, and harp. Most musical strings require human contact along at least a portion of the strings in order to be played, such as in the fingering and plucking of guitar strings.

Musical strings have historically suffered from corrosion issues due to contact with the ambient environment and human hands, as well as the inherent galvanic activity due to the different reduction potentials between the wrap wire and core wire. While straight (non-wound) strings can be easily wiped of dirt, skin oils, and perspiration after use, wound strings tend to become contaminated with contaminants that cannot easily be removed, providing an electrolytic ambient that further promotes galvanic activity and thus corrosion. Corrosion diminishes the bond between the core wire and wrap wire, altering the strings' characteristics and characteristics of the sounds they produce. After a relatively short period of time, a typical wound string will become musically "dead" due to the compromised bond between the core and wrap wires. In addition, oxidation of the wrap wire may cause further contamination issues as well as friction between the windings causing tonal degradation. Strings that lose their tonal qualities must be removed from the instrument and replaced. This process is burdensome, time consuming, and expensive for musicians who play frequently and require high tonal quality.

Over the years various efforts have been made to solve this vexing problem of corrosion due to the ambient environment and human contamination, with various degrees of success. For example, wound strings are often plated with a metal that is more corrosion-resistant than the wrap wire or coated with a polymer that is intended to prohibit contaminants from infiltrating the windings. For example, because PTFE and ePTFE are so slippery, they have been applied to the outside of the wrapped string to protect the strings from contamination sticking to the string. Similarly, polymer coatings have been applied to the core wire in an attempt to protect the strings from contamination and resultant corrosion, but were unsuccessful because the polymer coating prevented a good bond between the core wire and the wrap wire. Core wires of hexagonal cross-section have been used to improve the bond between the core and the wrap wire, but the resultant tone is not as warm as that from round core strings.

A need exists, therefore, to reduce corrosion of musical strings and keep the desired tonal quality. An object of this invention is to provide a method of making strings that reduces corrosion at the core-to-wrap interface. Another object of this invention is to provide a method of making strings that improves the core wire-to-wrap wire bond to prevent contamination from getting to the core wire. Another object of this invention is to provide a method of making strings that reduces corrosion at the core-to-wrap interface caused by inherent galvanic activity between the wrap wire and core wire.

SUMMARY OF THE INVENTION

This invention is a method of making a corrosion-resistant string for a musical instrument. The method improves the core wire-to-wrap wire bond by using a bond coating between the core and wrap wires that preferably also minimizes the galvanic activity between them. The bondable coating is applied to the core or wrap wires, or both, during the process of making the string. In one embodiment the method entails creating a coated core wire by annealing bare core wire, bathing the bare core wire in a bondable coating material and removing any excess bondable coating material, drying the bondable coating, making the string using the bondable-coated core wire, and reflowing the bondable coating. In a preferred embodiment the method entails additionally coating the wrap wire with a coating that does not reflow under the same conditions as the bondable coating on the core wire, and winding the coated wrap wire around the bondable-coated core wire before reflowing the bondable coating. In another embodiment the method entails additionally coating the wrap wire with a bondable coating before it is wound around the bondable-core wire. In yet another embodiment the method entails only coating the wrap wire with a bondable coating—and not the core wire—before the wrap wire is wound around the bondable coated-core wire.

DETAILED DESCRIPTION OF THE INVENTION

Figure 1A:
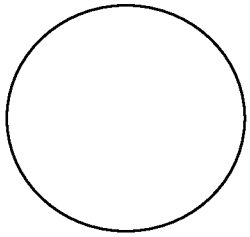
FIG. 1A is a cross-sectional view of bare core wire used for making strings for musical instruments.
Figure 1B:
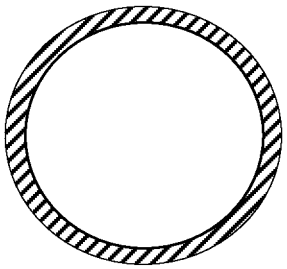
FIG. 1B is a cross-sectional view of the core wire of FIG. 1A coated in a bondable coating.
Figure 1C:
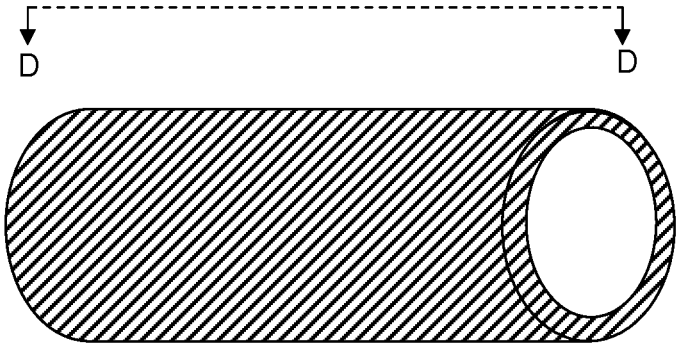
FIG. 1C is a perspective cross-sectional view of bondable-coated core wire.
Figure 1D:
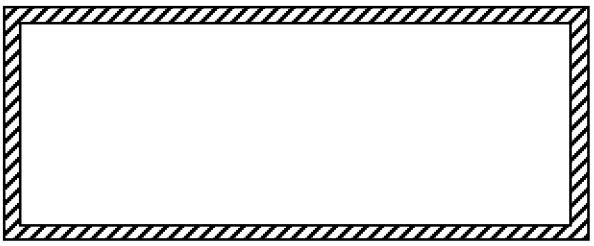
FIG. 1D is a cross-sectional view of coated core wire along the plane D-D indicated in FIG. 1C.
Figure 2A:
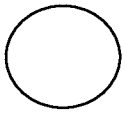
FIG. 2A is a cross-sectional view of bare wrap wire used for making strings for musical instruments.
Figure 2B:
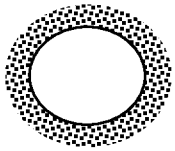
FIG. 2B is a cross-sectional view of coated core wire of FIG. 2A.
Figure 2C:
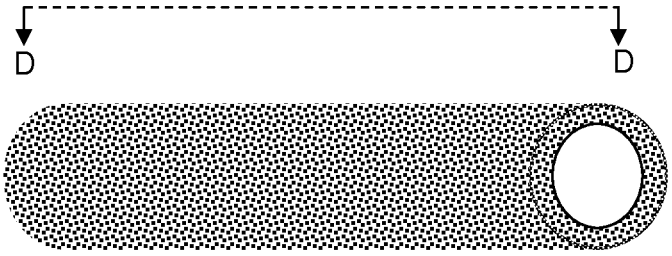
FIG. 2C is a perspective cross-sectional view of coated core wire.
Figure 2D:
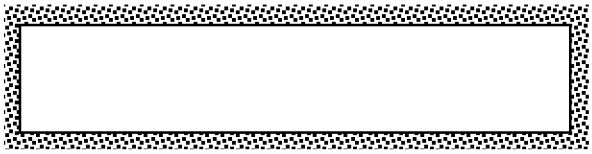
FIG. 2D is a cross-sectional view of coated core wire along the plane D-D indicated in FIG. 2C.
Figure 3:
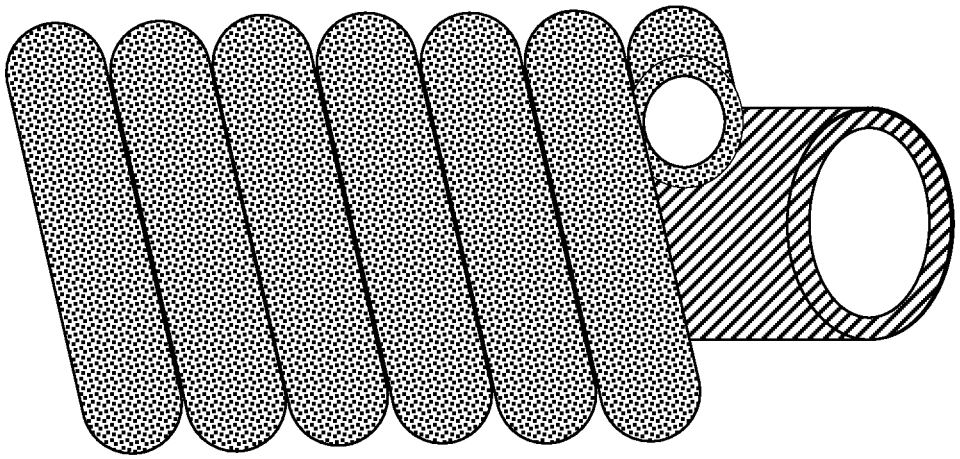
FIG. 3 is a perspective, partial cut-away view of a wound string for a musical instrument.
Figure 4A:
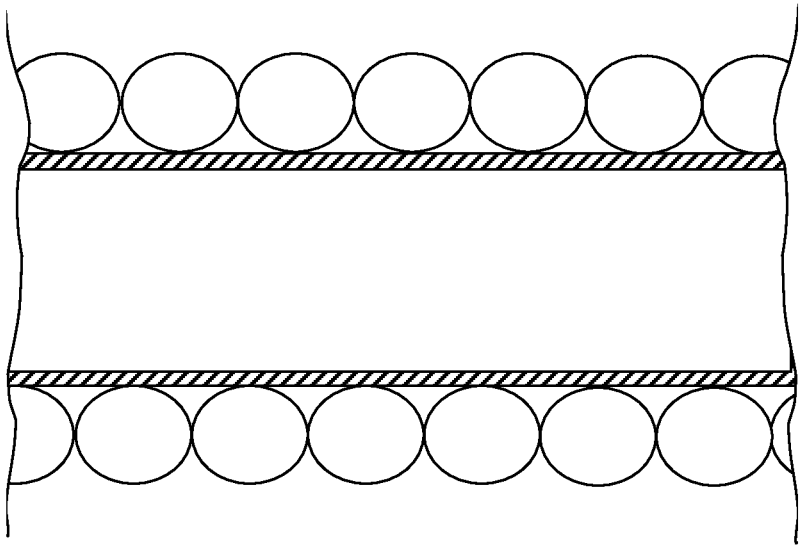
FIG. 4A is a cross-sectional view of wound string for a musical instrument with a coated core wire before reflow.
Figure 4B:
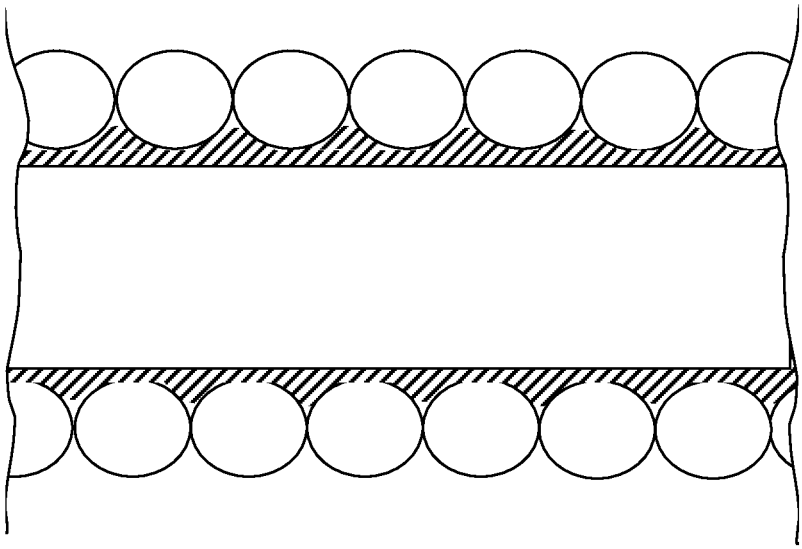
FIG. 4B is a cross-sectional view of wound string for a musical instrument with a coated core wire after reflow.
Figure 5A:
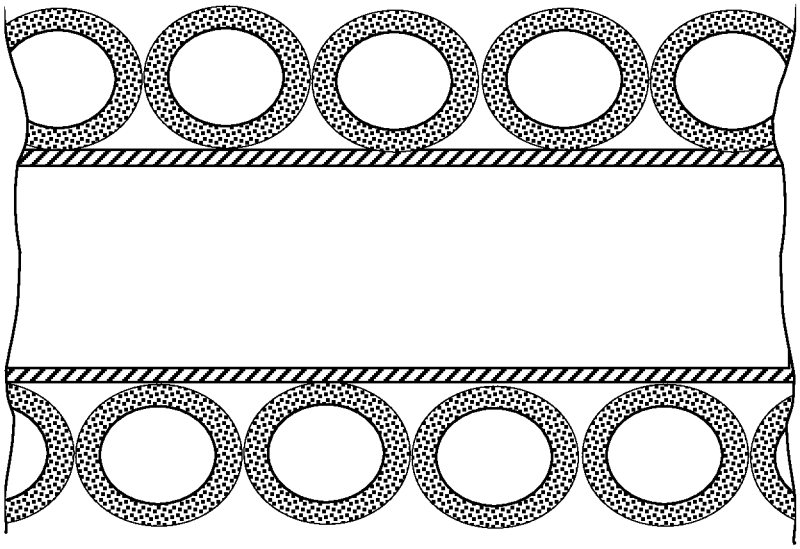
FIG. 5A is a cross-sectional view of wound string for a musical instrument with coated core and wrap wires before reflow.
Figure 5B:
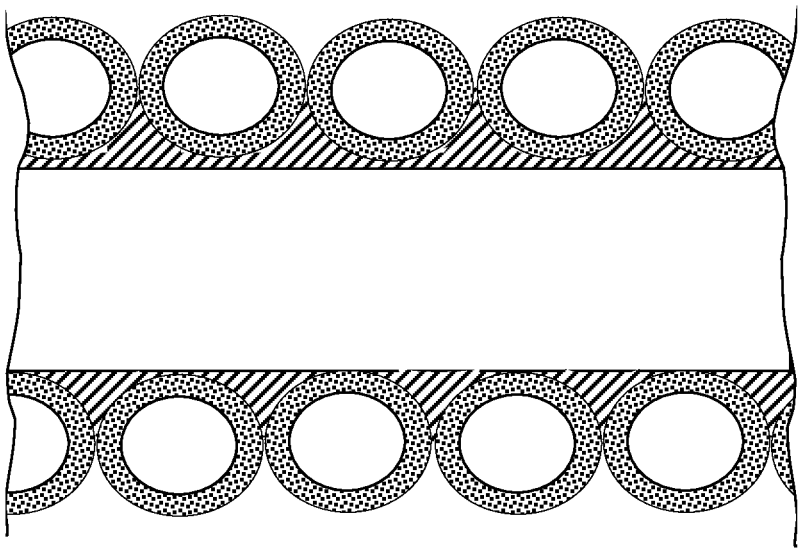
FIG. 5B is a cross-sectional view of wound string for a musical instrument with coated core and wrap wires after reflow.

The present invention is a method of making a musical string that resists corrosion and the string made from this method. The disclosed method protects the string wire during wire processing, string assembly, and the finished product from corrosion. This method minimizes or eliminates problems with galvanic corrosion by providing a layer of insulation between the anodic and cathodic relationship that exists when core wire and wrap wire contact in the typical wound string. The method also minimizes or eliminates degradation of the finished string from exposure to ambient or human contamination. In addition, a superior bond is established between core and wrap wires insuring better tonality over a longer period of time compared to existing methods of coated musical instrument string manufacture.

The process involves the use of bondable coatings that increase the bond between the core wire and the wrap wire to physically prevent corrosion from getting to the core wire. The bondable coatings are preferably also sufficiently electrically-insulative to prevent galvanic activity between the core wire and the wrap wire. In essence the process involves making an insulating layer tightly bound between the core wire and wrap wire. To make the layer a bondable coating is applied to the core or wrap wires, or both, during the process of making the string. As used herein, a bondable coating material is a substance that when applied to a substrate can increase the chemical or mechanical interaction, or both, between the substance and a subsequent layer such that the substrate and subsequent layer do not separate easily. In the preferred embodiment, the interaction—and the bond—is maximized as a consequence of reflow. Reflow, as used herein, means to change the chemical or material properties of a coating so that it is tightly attached to the wire. As used herein, a non-bondable coating is one that does not reflow under the same conditions as the bondable coating it is being used with. A non-bondable coating may be bondable under different conditions, however.

In general the process of making the corrosion-resistant string involves bathing a bare wire in a bondable coating material; drying the bondable coating; wrapping a wrap wire around a core wire to form a raw string; and reflowing the bondable coating to form a finished string. Various embodiments of the process include optional and additional process steps. If the core wire is coated with a bondable-material, the wrap wire can be coated in a non-bondable material. Optionally, the bare wire is annealed prior to bathing it in the coating, to soften the wire and clean it by burning off oils and dirt. In some embodiments, the whole of the musical instrument string is coated. In some embodiments, only a portion of the string is coated. FIGS. 1A-D illustrate a core wire and FIGS. 1A-D illustrate a wrap wire. FIGS. 3, 4A-B, and 5A-B illustrate a wound string.

Bathing the wire in the bondable coating material is preferably achieved by passing the wire through a pool of bondable coating material, immersing the wire so that the surface of it is covered in bondable coating material. As used herein, bathing includes other ways of coating the wire with coating material, such as dipping or otherwise immersing it in coating material; brushing or spraying it with coating material; or depositing the coating material by vapor deposition. The bondable coating is then dried, preferably by heat. However, as used herein, to dry means to toughen or harden the coating material by evaporating solvent or cross-linking polymer chains, brought about by chemical additives, evaporation, light, heat, or other method. Curing is the result of drying the coating until it reaches nearly a steady state of toughness or hardness despite further drying treatment.

After drying, the raw string is assembled by wrapping a wrap wire around a core wire, and then processed to reflow the bondable coating utilizing either temperature or solvent reflow, peculiar to the type of coating material used. For temperature reflow the assembled strings are placed in an inline or batch oven at an elevated temperature or allowed to dry at room temperature. Time at temperature varies depending on string size, coating thickness and type, and typically ranges from 1-30 minutes. For solvent reflow, the solvent is applied to the coated wire by utilizing a saturated wick that contacts the wire, causing the coating to reflow, and allowing excess solvent to evaporate. Alternatively, the solvent can be applied by dipping the string in the solvent.

Figure 6:
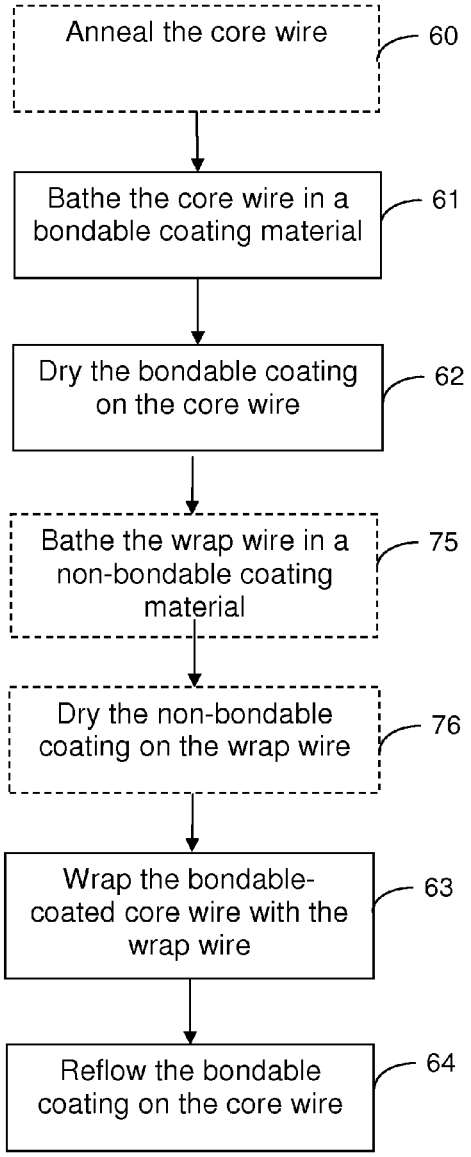
FIG. 6 is a flow diagram of an embodiment of the present method in which the core wire is coated with bondable coating material.

FIG. 6. illustrates an embodiment of the present method. Steps outlined in boxes of dashed lines represent optional additional steps of the embodiment. The core wire is annealed 60 and then bathed in a bondable coating material 61 and dried 62. Optionally, if a treated wrap wire is desired, the wrap wire is bathed in a coating material. FIG. 6 shows that the wrap wire is bathed in a non-bondable coating material 75 and dried 76. The bondable-coated core wire is wrapped with the non-bondable-coated wrap wire 63. Then the raw string is treated to reflow the bondable coating on the core wire 64 without reflowing the non-bondable coating on the wrap wire. In this way, a string made using a bondable-coated core wire and a non-bondable coated wrap wire achieves the tight bond between the core and the wrap wires but the exterior layer of the string with the non-bondable coating doesn't form the tight bond with the exterior layer of other finished strings. This has the advantage of allowing batch reflow of raw strings without causing the strings to stick together.

Figure 7:
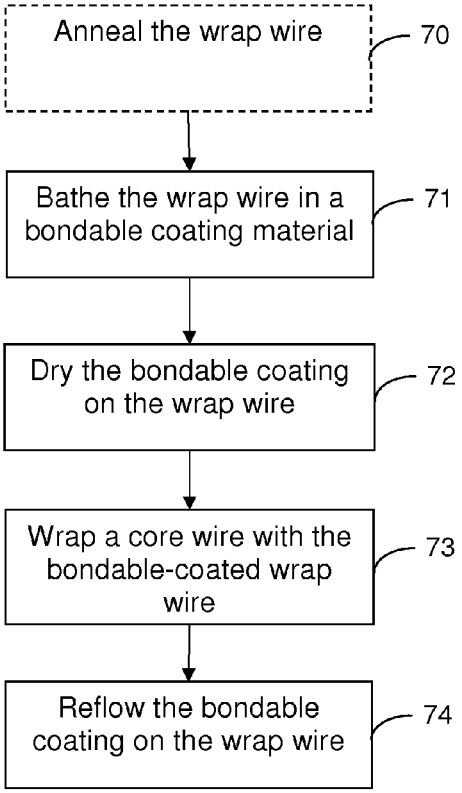
FIG. 7 is a flow diagram of an embodiment of the present method in which the wrap wire is coated with bondable coating material.

FIG. 7 illustrates another embodiment of the present method. The wrap wire is optionally annealed 70 and then bathed in a bondable coating material 71 and dried 72. The bondable-coated wrap wire is wrapped around a core wire 73, which may or may not be coated itself. Then the raw string is treated to reflow the bondable coating on the wrap wire 74, securing the wrap wire to the core wire. Depending on the type of coating on the core wire, it may or may not reflow when the wrap wire coating reflows.

Suitable bondable coating types include polyvinyl butryal ("PVB"), epoxy, polyester, polyamide and solutions of cresols, due to their flexibility, durability, reflow capability and cost effective nature. Typical reflow temperatures for PVB range from 110-140° C.; epoxy ranges from 150-200° C.; polyester ranges from 190-210° C.; polyamide ranges from 200-230° C.; and cresol solutions from 90-120° C.; Solvent for reflowing PVB is alcohol; for epoxy and polyester is methylethylketone ("MEK); and for cresol bond coats is alcohol. Polyamide does not have a suitable solvent for reflow. Preferably the bondable coating material is bondable at both the coating-to-core wire interface and the coating-to-wire wrap interface. A most practical way to test for an adequate bond between the core wire and the wrap wire is to pull the wrap wire from the core wire using needlenose pliers. If there is resistance, the wires are adequately bound. Suitable non-bondable coating materials include polyesters, urethanes, and conventional wrap wire coatings that does not reflow under the conditions that cause the bondable coating materials to reflow.

Preferably each bondable coating material used herein is both bondable and electrically insulative, although a separate bondable coating material and a separate electrically insulative coating material could be used in place of a single coating material. An electrically insulative coating material is a substance that when applied to a substrate reduces the galvanic activity between the substrate and a subsequent layer such that corrosion due to differing reduction potentials is minimal or non-existent. For example, historically wrap wire is wound directly over bare core wire with no substance in between. While air is arguably insulative, due to the contaminants introduced into the airspace between the core and wire wrap of a prior art string, air is not sufficiently electrically insulative to prevent corrosion, and the galvanic activity between the wrap wire and the core wire eventually results in corrosion due to oxidation of one of the wires. By separating the wrap wire from the core wire with an electrically insulative coating material, the galvanic activity is minimized or eliminated, enhancing the corrosion protection of a tight bond between the core and wrap wire.

In a first embodiment, the core is coated with a bondable coating material but the wrap wire is not. A bare core wire is bathed in a bondable coating material, the excess coating material removed, and the coating dried. The core wire may be passed through the coating applicator and oven as many times as desired to achieve the desired coating thickness, typically between 1-12 times. Optionally, the bare core wire is annealed prior to bathing it in the bondable coating, preferably by pulling it through an annealing furnace as it is unwound from the spool. After completion of the coating process the bondable-coated core wire may then be re-wound on spools for later use during wound musical instrument string manufacture. The process of making the musical string then continues by cutting the bondable-coated core wire to the desired length and attaching a ball or loop to the end opposite the tuning end of the string. The wrap wire—uncoated or coated with a non-bondable coating—is wrapped around the coated core wire, forming a raw string. The bondable coating on the raw string reflowed to form a finished string, using either a heat or solvent reflow process that does not reflow the wrap wire coating if there is one.

In a specific example of the first embodiment, the core is coated with a bondable coating material and the wrap wire is coated in a non-bondable coating material:

Example 1

A core wire of steel is unwound from its spool and passed through an annealing furnace at 900° C. The core wire is then passed through a bath of a solution of bondable material, such as Bondcoat D 323-15 (available commercially as product number B3-100 from Elantas PDT, Inc.), in a coating applicator and drawn through an orifice or coating die to scrape of the excess coating material. The bondable-coated core wire is then dried by passing it through an inline blower operating at room temperature and then through an oven at 315° C. for three minutes. For a coating thickness of 0.0003-0.0007 inch, the core wire is typically coated 2 times.

A wrap wire of steel is unwound from its spool and passed through an annealing furnace at 900° C. The wrap wire is then passed through a bath of a solution of non-bondable material such as polyester-polyurethane clear varnish (available commercially as GPS01-001 from Watson-Rhenenia Co.) in a coating applicator and drawn through an orifice or coating die to scrape of the excess coating material. The nonbondable-coated wrap wire is then dried by passing it through an inline blower operating at room temperature and then through an oven at 315° C. for three minutes. For a coating thickness of 0.0003-0.0007 inch, the wrap wire is typically coated 6 times.

The bondable-coated core wire is then spiral-wrapped by the non-bondable coated wrap wire to form a raw string. The raw string is heated at 120° C. for 25 minutes to reflow the bondable coating—but not the non-bondable coating—and render the string corrosion resistant.

In another embodiment, both the core wire and the wrap wire are coated with bondable coatings. The core wire is coated with a first bondable coating then dried. The wrap wire is coated with a second bondable coating then dried. Preferably the first and second coatings are different, although they may be the same. Optionally, the bare core or wrap wires, or both, are annealed prior to bathing them in the coatings. The process then continues by cutting coated core wire to the desired length and attaching a ball or loop to the end opposite the tuning end of the string. The coated wrap wire is wrapped around the coated core wire, forming a raw string. Both coatings on the raw string are reflowed using either heat or chemicals to form a finished string.

In yet another embodiment, the wrap wire is coated pursuant to the present method but the core wire is not. In this embodiment the bare wrap wire is bathed in a bondable coating material, excess coating material removed, and the coating dried. The wrap wire may be passed through the coating applicator and oven as many times as desired to achieve the desired coating thickness. Optionally, the bare wrap wire is annealed prior to bathing it in the coating. The process then continues by cutting core wire—uncoated or coated with a non-bondable coating—to the desired length and attaching a ball or loop to the end opposite the tuning end of the string. The coated wrap wire is wrapped around the core wire, forming a raw string. The coating on the raw string is reflowed using either heat or solvent to form a finished string.

While there has been illustrated and described what is at present considered to be the preferred embodiment of the present invention, it will be understood by those skilled in the art that various changes and modifications may be made and equivalents may be substituted for elements thereof without departing from the true scope of the invention. Therefore, it is intended that this invention not be limited to the particular embodiment disclosed, but that the invention will include all embodiments falling within the scope of the appended claims.

I claim:

1. A method of making a corrosion-resistant string for a musical instrument comprising:

a. bathing a bare core wire in a bondable coating material;

b. drying the coating;

c. wrapping a wrap wire around the bondable-coated core wire to form a raw string; and reflowing the bondable coating, wherein the coating material is also electrically insulative.

2. A method of making a corrosion-resistant string for a musical instrument comprising:

a. bathing a bare core wire in a bondable coating material;

b. drying the coating;

c. wrapping a wrap wire around the bondable-coated core wire to form a raw string; and d. reflowing the bondable coating wherein the bondable coating material is a thermoplastic polymer.

3. A method of making a corrosion-resistant string for a musical instrument comprising:

a. bathing a bare core wire in a bondable coating material;

b. drying the coating;

c. wrapping a wrap wire around the bondable-coated core wire to form a raw string; and d. reflowing the bondable coating wherein the bondable coating material is a solution of one or more cresols.

4. A method of making a string for a musical instrument comprising:

a. annealing a bare core wire;

b. bathing the bare core wire in a first coating material;

c. bathing a bare wrap wire in a second coating material;

d. drying the first and second coatings;

e. assembling the string by wrapping the coated wrap wire around the coated core wire; and reflowing the first coating material, wherein the first coating material is a solution of one or more cresols.

5. The method of claim 4 wherein the second coating material is a polyester-polyurethane.

* * * * *